US012612839B1

(12) United States Patent
Fuller et al.

(10) Patent No.: US 12,612,839 B1
(45) Date of Patent: Apr. 28, 2026

(54) EXPANDABLE POLYMER GROUT FOR SAND CONTROL IN A WELL

(71) Applicant: Chevron U.S.A. Inc., San Ramon, CA (US)

(72) Inventors: Michael James Fuller, Cypress, TX (US); Douglas Cory Arceneaux, Katy, TX (US); William Dale Wood, Montgomery, TX (US); John Bryan Trenery, Jr., Sugar Land, TX (US); Shannon Kirstin Stocks, Alvin, TX (US); Peter James Clark, The Woodlands, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 18/932,869

(22) Filed: Oct. 31, 2024

(51) Int. Cl.
*E21B 33/138* (2006.01)

(52) U.S. Cl.
CPC ..... *E21B 33/138* (2013.01)

(58) Field of Classification Search
None
See application file for complete search history.

(56) References Cited

U.S. PATENT DOCUMENTS

2009/0133875 A1* 5/2009 Tibbles ..... E21B 43/08 166/278
2009/0173497 A1* 7/2009 Dusterhoft ..... E21B 43/025 166/276
2010/0326654 A1* 12/2010 Hemblade ..... E21B 43/08 166/250.01
2015/0292294 A1* 10/2015 Grubert ..... E21B 43/04 166/191
2019/0186230 A1* 6/2019 Carragher ..... E21B 33/1208
2022/0034187 A1* 2/2022 Noui-Mehidi ..... E21B 33/1208
2022/0127934 A1 4/2022 Yun et al.
2022/0220832 A1* 7/2022 Mckay ..... E21B 43/108
2024/0026749 A1* 1/2024 Benet ..... C09K 8/44

FOREIGN PATENT DOCUMENTS

CN 112177572 A 1/2021
NO 2021-0997 A1 8/2021
WO WO-2020-172092 A1 8/2020
WO WO-2022132552 A1 * 6/2022 ..... C09K 8/508

* cited by examiner

*Primary Examiner* — Andrew Sue-Ako
(74) *Attorney, Agent, or Firm* — King & Spalding LLP

(57) ABSTRACT

An expandable polymer grout system provides sand control at a target location within a well. One deployment system mixes the expandable polymer grout system within the wellbore and places the grout at a failure point in a sand screen to form a polymer seal. Another deployment system mixes the expandable polymer grout system at the well's surface and transports the grout to a failure point in a sand screen to form a polymer seal. Yet another deployment system utilizes a canister system to mix the expandable polymer grout system within the wellbore and place the grout at a potential failure point in a sand screen to form a polymer seal.

18 Claims, 6 Drawing Sheets

EXPANDABLE POLYMER GROUT FOR SAND CONTROL IN A WELL

TECHNICAL FIELD

The present application relates to methods of deploying expandable polymeric materials for sealing sand screens and associated surfaces in a well for controlling the flow of sand.

BACKGROUND

Various types of wells are drilled for the purpose of extracting a resource, such as hydrocarbons or water, from an underground reservoir located in a formation. Additionally, wells can be drilled to inject substances into a formation to facilitate extraction of a resource. The flow of solids (e.g., sand, gravel, or proppant) from a formation into the well can have deleterious effects on the well. First, the flow of solids from a formation into a well can erode and damage equipment, such as sand screens, located in the wellbore. Second, the flow of solids can adversely affect the production of a resource from a reservoir.

In some situations, the flow of solids into a well may be controlled by shutting off the interval of the well where the sand flow is occurring. For example, chemical solutions containing cement can be injected at the interval where the sand flow is occurring to seal off the interval. Another approach is to use mechanical means, such as a bridge-plug, mechanical patch, or blank pipe across the interval where the sand flow is occurring to seal off the interval. However, these existing approaches to shutting off a well interval are not always successful. Additionally, when these existing approaches are successful, they completely seal off the well interval from future production or use. Accordingly, improved methods for controlling the flow of sand from a formation into a well would be beneficial.

SUMMARY

This summary is provided to introduce various concepts in a simplified form that are further described below in the detailed description. This summary is not intended to identify required or essential features of the claimed subject matter nor is the summary intended to limit the scope of the claimed subject matter.

The embodiments disclosed herein are generally directed to deploying expandable polymeric materials for sealing sand screens. In one example embodiment, a method for sealing a sand screen in a wellbore may comprise: (i) identifying a failure point in the sand scree; (ii) providing, with a deployment system, an expandable polymer grout system to a target location within the wellbore; (iii) combining, with the deployment system, components of the expandable polymer grout system within the wellbore to form a grout; (iv) delivering the grout to the failure point in the sand screen; and (v) allowing the grout to cure thereby forming a polymer seal at the failure point in the sand screen.

In another example embodiment, a method for sealing a sand screen in a wellbore may comprise: (i) identifying a failure point in the sand screen; (ii) combining, with a deployment system at a surface of the wellbore, components of an expandable polymer grout system to form a grout; (iii) providing the grout to the failure point in the sand screen; and (iv) allowing the grout to cure thereby forming a polymer seal at the failure point in the sand screen.

In yet another example embodiment, a method for sealing a sand screen in a wellbore may comprise: (i) identifying a potential failure point in the sand screen; (ii) combining, with a deployment system, components of an expandable polymer grout system to form a grout; (iii) delivering the grout to the potential failure point in the sand screen; and (iv) allowing the grout to cure thereby forming a polymer seal at the potential failure point in the sand screen.

DEFINITIONS

Figure 1:
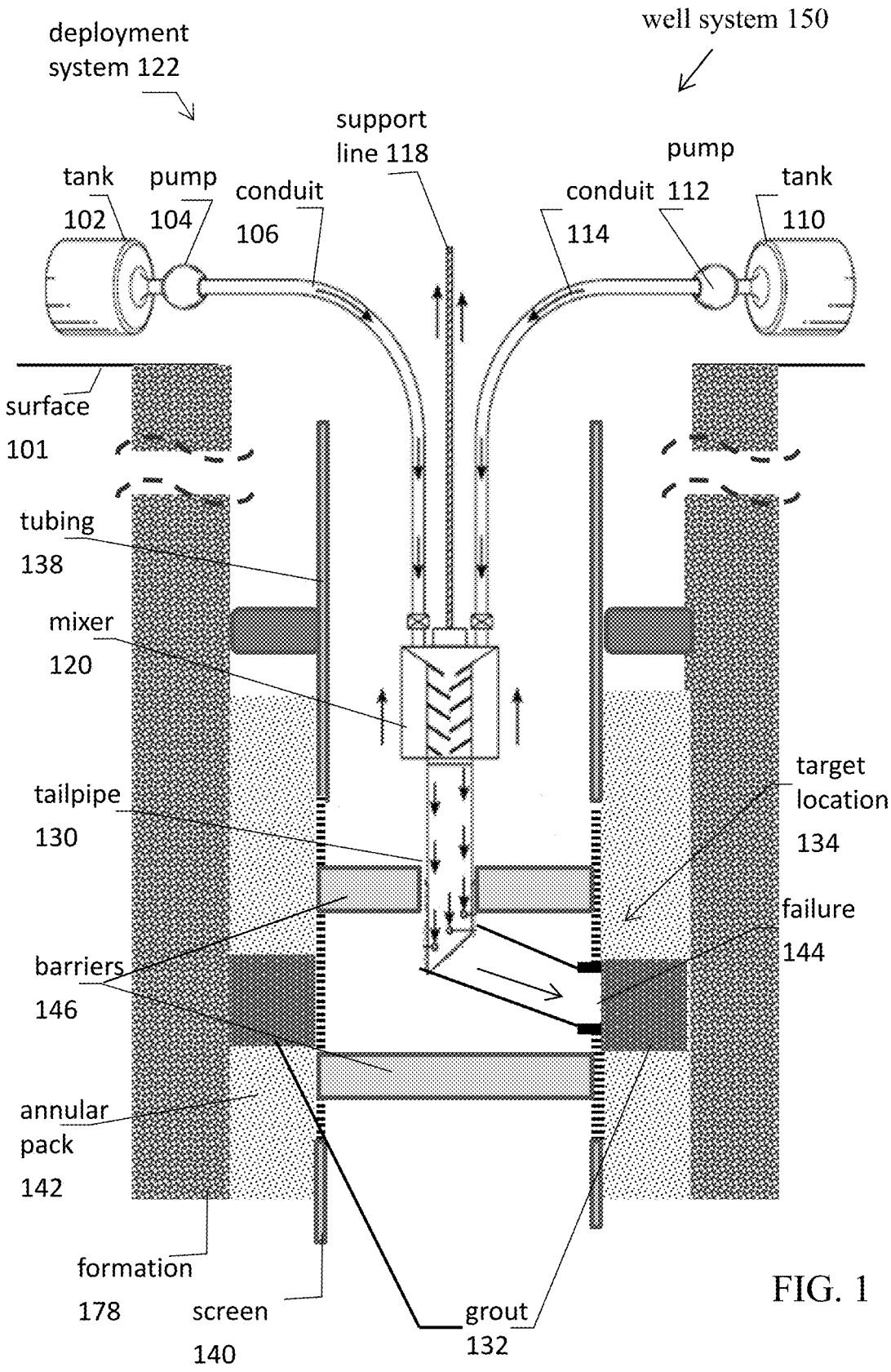
FIG. 1 is a sectional view drawing of a well system illustrating a method of placing a polymer seal at a failure point in a sand screen in accordance with the example embodiments described herein.

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology can be applied, as long as that definition does not conflict with any other disclosure or definition applied herein or render indefinite or non-enabled any claim to which that definition is applied. To the extent that any definition or usage provided by any document incorporated herein by reference conflicts with the definition or usage provided herein, the definition or usage provided herein controls.

While compositions and methods are described in terms of "comprising" various components or steps, the compositions and methods can also "consist essentially of" or "consist of" the various components or steps, unless stated otherwise.

The terms "a," "an," and "the" are intended to include plural alternatives, e.g., at least one. The terms "including", "with", and "having", as used herein, are defined as comprising (i.e., open language), unless specified otherwise.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. For example, all numerical end points of ranges disclosed herein are approximate, unless excluded by proviso.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, ±3% of the stated value, or ±1% of the stated value.

The term "polymer seal" is used herein to refer to a polymer barrier placed at a target location within a wellbore, the polymer barrier being created by the expandable polymer grout systems described herein. The polymer seal may be placed at a failure point or potential failure point in a sand screen located within the wellbore. The sand screen may be located in an open hole or cased section of a well. The polymer seal may be formed along the sand screen or may extend into the annulus surrounding the sand screen. In certain embodiments, the polymer seal may seal a portion of the annulus as well as a portion of the formation surrounding the sand screen in the wellbore. The polymer seal may be configured to be permeable or impermeable with respect to a resource produced from the formation in which the wellbore is disposed.

As referred to herein, the term "wellbore" includes the borehole in the formation and any tubulars, completion components, and compositions positioned therein.

As referred to herein, the term "coupled" can refer to two components that are in direct contact or directly attached to one another as well as two components that are joined or attached by a third component.

DESCRIPTION OF THE EXAMPLE EMBODIMENTS

Expandable polymer grout systems and associated deployment methods are disclosed herein that are useful for isolating, repairing, remediating, and/or preventing failures in sand screens located within a well. The systems and methods described herein can be used in a variety of wells, including production wells and injection wells, which may be located onshore or offshore. The expandable polymer grout systems and methods described herein are particularly beneficial with respect to treating sand screens for sand control because of the ability of the expandable polymer grout systems to expand in and around the sand screen thereby addressing a failure point or potential failure point in the sand screen. The expandable polymer grout systems can be designed with a relatively low viscosity that facilitates expansion of the expandable polymer grout system through the sand screen and the surrounding volume as the grout cures to form a polymer seal. The polymer seal placed within the previous point of failure can prevent the passage of solids (e.g., sand, proppant, gravel) and fluids through the segment of the sand screen at which the failure point or potential failure point is located. Moreover, in certain embodiments, the expandable polymer grout system is configured to create an open-cell polymer seal that is permeable to fluids thereby allowing the treated well interval to continue to produce a resource from the formation.

The systems and methods described herein provide strategies for addressing sand screen failures that are simpler to deploy than prior approaches that are more disruptive to the well. As referenced above, one prior approach to addressing sand screen failures involves placing cement at the failure point. However, cement has a relatively high viscosity and can be brittle after it cures. These characteristics of cement can render it ineffective at creating the type of durable barrier needed in and around a failure point in a sand screen. Furthermore, cement can be an inadequate approach for sealing voids of unknown dimension surrounding the sand screen.

In contrast to cement, the expandable polymer grout described herein can expand to fill voids around the sand screen and can bond more effectively to the sand screen. After curing, the expandable polymer grout can be more flexible and resilient than cement, thereby providing greater durability in the wellbore. Accordingly, expandable polymer grout can provide a more effective seal within any repaired failure points in a sand screen within a wellbore.

Expandable Polymer Grout System

As explained in greater detail below, the expandable polymer grout systems described herein can comprise an isocyanate component and an organic polyol component that react to form the expandable polymer grout. In certain embodiments, the expandable polymer grout systems are deployed with a blowing agent to a downhole location, for example, in a wellbore. The blowing agents can be physical or chemical blowing agents. Blowing agents can be, for example, inert liquids that have low boiling points and non-reactivity to isocyanate groups. These blowing agents are evaporated during exothermic reaction of polyurethane to generate blowing gas. In certain embodiments, the components of the expandable polymer grout system are in liquid or solution form (injectable during deployment) and will set up into an expanded state once adequately mixed together and placed at a target location along an interval in a wellbore.

The expandable polymer grout system according to the embodiments herein can be optimized in order to achieve various performance properties to ensure successful application through the example methods described herein. In particular, the systems and methods can be varied to optimize viscosity, permeability, density volume of expansion, expansion percentage, curing time and water sensitivity.

In certain embodiments, the system may, under wellbore temperatures and pressures, render an expanded and cured solid polymer that will seal the sand screen and adjacent volumes in the screen annulus and/or surrounding formation. In certain embodiments, the seal is gas-tight, comprising properties of minimal fluid-loss and short transition time (<30-45 min). In certain embodiments, the cured expanded polymer grout system provides minimal shrinkage over years downhole in order to maintain the seal along the formation face.

Depending on the level of expansion (due to action of the blowing agents in the system), the resultant polymer seal may vary significantly in the ultimate density (known as the free-rise density). Conversely, the hydrostatic pressure and applied surface pressure during placement may inhibit some expansion of the grout leading to higher cured densities. In certain embodiments, the expandable polymer grout system described herein yields polymer seals that range in free rise density from about 2 to about 62 lbm/ft$^3$. In certain embodiments, the expandable polymeric grout system has a confined density in the range of about 15 to about 40 lbm/ft$^3$. In certain embodiments, the volume of the reaction product (i.e., the volume of the polymer seal or the expanded and cured polymer grout system) is about 2 to 13 times the initial combined volume of the liquid precursor components of the polymer grout system before reacting. In certain embodiments, the expandable polyurethane grout system has a specific gravity after expansion in the range of about 0.05 to about 0.6, about 0.09 to about 0.53, about 0.09 to about 0.30, or about 0.09 to about 0.15.

Differences in the expandable polymer grout system may lead to differences in the curing time. Practitioners in polyurethane chemistry often report several types of time for each system (from the "cream time", at which the solution color becomes turbid, through the "rise time"); and differences in the system, specifically the selection and concentrations of blowing agent and catalysts, can lead to differences in curing time. In certain embodiments, the expandable polymer grout system is optimized with regards to curing times to ensure that the expansion and setting does not occur until the full volume of blended components are placed at the target location along a formation face.

Depending on the components of the expandable polymer grout system, the system may have higher or lower sensitivity to water that may be experienced downhole (including in the formation matrix itself). In certain embodiments, the expandable polymer grout system is designed to minimize sensitivity to downhole water (which would lead to higher expansion and lower final density), optionally through the use of blocking agents in the chemistry of the isocyanate precursors.

In certain embodiments, the expandable polymer grout system, or method of injecting the system, is designed to minimize sensitivity to any fluids that may reside in the wellbore or formation porosity prior to injection. In certain embodiments, the methods described herein involve the injection of either a fluid or gas pre-flush to displace near wellbore fluids deeper into the formation, up the annulus, or up the wellbore, prior to injection of the polyurethane precursor blend.

Generally, the expandable polymer grout system comprises a polyurethane. The polyurethane is formed from the reaction of an isocyanate component and an organic polyol component. In certain embodiments, the reaction of the isocyanate component and the organic polyol component proceeds by combining the components in the presence of a blowing agent and, optionally, a catalyst, at a temperature of at least about 15° C. or about 20° C. to form the expandable polymer grout. In certain embodiments, the reaction of the isocyanate component and the organic polyol component proceeds by combining the components in the presence of a blowing agent and, optionally, a catalyst, at a temperature in the range of about 15° C. to about 60° C., or about 20° C. to about 40° C.

The term "polyurethane", as referred to herein, is not limited to those polymers which include only urethane or polyurethane linkages. In certain embodiments, the polyurethane polymers may also include allophanate, carbodiimide, uretidinedione, and other linkages in addition to urethane linkages.

In one embodiment, an expandable polymer grout system comprises the reaction product of: (i) an isocyanate component comprising one or more isocyanate compounds; and (ii) an organic polyol component comprising one or more organic polyol compounds; in the presence of (iii) one or more blowing agents. In certain embodiments, the expandable polymer grout system further comprises one or more auxiliary components, as described herein.

In certain embodiments, the expandable polymer grout comprises about 40 to about 60 percent by weight the isocyanate component and about 40 to about 60 percent by weight the organic polyol component.

In certain embodiments, the expandable polymer grout system can be deployed (e.g., injected) into or through the wellbore as a pre-mixed system of the isocyanate component and the organic polyol component, wherein at least one of the components is slow-reacting or has delayed activation.

Due to the commonly rapid formation of the polyurethane product upon combining the isocyanate component and organic polyol component, it may be necessary to separate the components until they are placed at or near the target location for the polymer seal. Preferably, the expandable polymer grout system, as well as the isocyanate and organic polyol components, each exhibit low viscosities that are in the range of 25 cP to 500 cP, more preferably in the range of 25 cP to 200 cP, and even more preferably in the range of 25 cP to 100 cP. In certain embodiments, the expandable polymer grout system can be deployed (e.g., injected) into or through the wellbore as a two-component system, wherein the isocyanate component and the organic polyol component are introduced separately. In certain embodiments, the isocyanate component and the organic polyol component are mixed downhole, for example near or at the wellbore interval that is the target location. However, in embodiments in which the expandable polymer grout system exhibits a slower curing time, the isocyanate and polyol components may be mixed at the surface of the well bore before directing the combination to the target location within the wellbore.

In example embodiments, the isocyanate component and the organic polyol component will be in liquid form, where the viscosity of the components may vary. In other embodiments, the isocyanate component and the organic polyol component may be dissolved in inert solvents to reduce the viscosities.

In certain embodiments, the expandable polymer grout system yields a flexible/elastomeric material. In certain embodiments, the expandable polymer grout system yields a low-permeability seal along a sand screen after polymerization and curing; in alternative embodiments, the expandable grout system yields a more permeable mass where placed along the sand screen after polymerization and curing. In certain embodiments, the expandable polymer grout system yields materials or a polymer seal that exhibit chemical bonding to one or more of the sand screen, the annular pack, the casing, or the formation.

Isocyanate Component

According to the embodiments, the isocyanate component may comprise one or more types of isocyanate compounds. In certain embodiments, the isocyanate compound is a polyisocyanate having two or more functional groups, e.g., two or more NCO functional groups. According to one embodiment, the polyisocyanate includes those represented by the formula Q(NCO), where n is a number from 2-5 and Q is an aliphatic hydrocarbon group containing 2-18 carbon atoms, a cycloaliphatic hydrocarbon group containing 5-10 carbon atoms, an araliphatic hydrocarbon group containing 8-13 carbon atoms, or an aromatic hydrocarbon group containing 6-15 carbon atoms.

Suitable isocyanates for purposes of the present invention include, but are not limited to, aliphatic and aromatic isocyanates. In certain embodiments, the isocyanate is selected from the group consisting of diphenylmethane diisocyanates (MDIs), polymeric diphenylmethane diisocyanates (pMDIs), toluene diisocyanates (TDIs), hexamethylene diisocyanates (HDIs), isophorone diisocyanates (IP- DIs), ethylene diisocyanate; 1,4-tetramethylene diisocyanate; 1,12-dodecane diisocyanate; cyclobutane-1,3-diisocyanate; cyclohexane-1,3-and-1,4-diisocyanate, and mixtures of these isomers; 2,4- and 2,6-hexahydrotoluene diisocyanate and mixtures of these isomers; dicyclohexylmethane-4,4'-diisocyanate 1,3- and 1,4-phenylene diisocyanate; naphthylene-1,5-diisocyanate; triphenylmethane-4,4',4"-triisocyanate; polyphenyl-polymethylene-polyisocyanates of the type which may be obtained by condensing aniline with formaldehyde, followed by phosgenation (polymeric MDI); norbornane diisocyanates; m- and p-isocyanatophenyl sulfonylisocyanates; perchlorinated aryl polyisocyanates; modified polyfunctional isocyanates containing carbodiimide groups, urethane groups, allophonate groups, isocyanurate groups, urea groups, or biruret groups; polyfunctional isocyanates obtained by telomerization reactions; polyfunctional isocyanates containing ester groups; and polyfunctional isocyanates containing polymeric fatty acid groups; and combinations thereof.

Suitable isocyanates for use in the expandable polymer grouts described herein include but are not limited to: toluene diisocyanate; 4,4'-diphenylmethane diisocyanate; m-phenylene diisocyanate; 1,5-naphthalene diisocyanate; 4-chloro-1; 3-phenylene diisocyanate; tetramethylene diisocyanate; hexamethylene diisocyanate; 1,4-dicyclohexyl diisocyanate; 1,4-cyclohexyl diisocyanate, 2,4,6-toluylene triisocyanate, 1,3-diisopropylphenylene-2,4-diisocyanate; 1-methyl-3,5-diethylphenylene-2,4-diisocyanate; 1,3,5-triethylphenylene-2,4-diisocyanate; 1,3,5-triisoproply-phenylene-2,4-diisocyanate; 3,3'-diethyl-bisphenyl-4,4'-diisocyanate; 3,5,3',5'-tetraethyl-diphenylmethane-4,4'-diisocyanate; 3,5,3',5'-tetraisopropyldiphenylmethane-4,4'-diisocyanate; 1-ethyl-4-ethoxy-phenyl-2,5-diisocyanate; 1,3,5-triethyl benzene-2,4,6-triisocyanate; 1-ethyl-3,5-diisopropyl benzene-2,4,6-triisocyanate and 1,3,5-triisopropyl benzene-2,4,6-triisocyanate. Other suitable rigid polyurethane foams can also be prepared from aromatic diisocyanates or isocyanates having one or two aryl, alkyl, arakyl or alkoxy substituents wherein at least one of these substituents has at least two carbon atoms.

In certain embodiments, the isocyanate has an NCO content of from about 25 to about 33 weight percent; a nominal functionality of from about 2 to about 3.5; and a viscosity of from about 60 to about 2000 cps, or about 200 to about 700 cps, at 25° C. (77° F.).

In certain embodiments, the isocyanate components comprise polymeric diphenylmethane diisocyanate.

In certain embodiments, the isocyanate component may be an isocyanate prepolymer. An isocyanate prepolymer comprises a reaction product of an isocyanate and a polyol and/or a polyamine. The isocyanate used in the prepolymer can be any isocyanate as described above. The polyol used to form the prepolymer is typically selected from the group of ethylene glycol, diethylene glycol, propylene glycol, dipropylene glycol, butane diol, glycerol, trimethylolpropane, triethanolamine, pentaerythritol, sorbitol, biopolyols, and combinations thereof. The polyamine used to form the prepolymer is typically selected from the group of ethylene diamine, toluene diamine, diaminodiphenylmethane and polymethylene polyphenylene polyamines, aminoalcohols, and combinations thereof. Suitable non-limiting examples of aminoalcohols include ethanolamine, diethanolamine, triethanolamine, and combinations thereof.

In certain embodiments, the isocyanate compounds may also be provided in a chemically "blocked" state, whereby a reaction to "deblock" the isocyanate may happen prior to polymerization, optionally under downhole conditions, to expose the active isocyanate functionalities. The exposed isocyanates will then react with the organic alcohol groups of the polyol to form the urethane bonds. As such, blocked isocyanate compounds can be used to prevent premature reaction of the isocyanate component with the organic polyol component. Blocked isocyanates regenerate the isocyanate function through heating. Typical unblock temperatures range between 65 to 200° C., depending on the isocyanate structure and blocking agent.

In certain embodiments, the isocyanate component comprises blocked isocyanate compounds, or an isocyanate compound that has been protected with a blocking agent.

Suitable isocyanate blocking agents may include alcohols (including phenols), ethers, phenols, malonate esters, methylenes, aceto acetate esters, lactams, oximes, ureas, bisulphites, mercaptans, triazoles, pyrazoles, secondary amines, glycolic acid esters, acid amides, aromatic amines, imides, diaryl compounds, imidazoles, carbamic acid esters, or sulfites.

Exemplary phenolic blocking agents include phenol, cresol, xylenol, chlorophenol, ethylphenol and the like.

Lactam blocking agents include gamma-pyrrolidone, laurinlactam, epsilon-caprolactam, delta-valerolactam, gamma-butyrolactam, beta-propiolactam and the like.

Methylene blocking agents include acetoacetic ester, ethyl acetoacetate, acetyl acetone and the like.

Oxime blocking agents include formamidoxime, acetaldoxime, acetoxime, methyl ethylketoxine, diacetylmonoxime, cyclohexanoxime and the like.

Mercaptan blocking agent include butyl mercaptan, hexyl mercaptan, t-butyl mercaptan, thiophenol, methylthiophenol, ethylthiophenol and the like.

Acid amide blocking agents include acetic acid amide, benzamide and the like. Imide blocking agents include succinimide, maleimide and the like.

Amine blocking agents include xylidine, aniline, butylamine, dibutylamine diisopropyl amine and benzyl-tert-butyl amine and the like.

Imidazole blocking agents include imidazole, 2-ethylimidazole and the like.

Imine blocking agents include ethyleneimine, propyleneiniine and the like.

Triazole blocking agents include 1,2,4-triazole, 1,2,3-benzotriazole, 1,2,3-tolyl triazole and 4,5-diphenyl-1,2,3-triazole.

Alcohol blocking agents include methanol, ethanol, propanol, butanol, amyl alcohol, ethylene glycol monomethyl ether, ethylene glycol monoethyl ether, ethylene glycol monobutyl ether, diethylene glycol monomethyl ether, propylene glycol monomethyl ether, benzyl alcohol, methyl glycolate, butyl glycolate, diacetone alcohol, methyl lactate, ethyl lactate and the like. Additionally, any suitable aliphatic, cycloaliphatic or aromatic alkyl monoalcohol may be used as a blocking agent in accordance with the present disclosure. For example, aliphatic alcohols, such as methyl, ethyl, chloroethyl, propyl, butyl, amyl, hexyl, heptyl, octyl, nonyl, 3,3,5-trimethylhexyl, decyl, and lauryl alcohols, and the like may be used. Suitable cycloaliphatic alcohols include, for example, cyclopentanol, cyclohexanol and the like, while aromatic-alkyl alcohols include phenyl carbinol, methylphenylcarbinol, and the like.

Dicarbonylmethane blocking agents include malonic acid esters such as diethyl malonate, dimethyl malonate, di(iso) propyl malonate, di(iso)butyl malonate, di(iso) pentyl malonate, di(iso) hexyl malonate, di(iso) heptyl malonate, di(iso) octyl malonate, di(iso) nonyl malonate, di(iso) decyl malonate, alkoxyalkyl malonates, benzylmethyl malonate, di-tert-butyl malonate, ethyl-tert-butyl malonate, dibenzyl malonate; and acetylacetates such as methyl acetoacetate, ethyl acetoacetate, propyl acetoacetate, butyl acetoacetate and alkoxyalkyl acetoacetates; cyanacetates such as cyanacetic acid ethylester; acetylacetone; 2,2-dimethyl-1,3-dioxane-4,6-dione; methyl trimethylsilyl malonate, ethyl trimethylsilyl malonate, and bis(trimethylsilyl) malonate. Malonic or alkylmalonic acid esters derived from linear aliphatic, cycloaliphatic, and/or arylalkyl aliphatic alcohols may also be used. Such esters may be made by alcoholysis using any of the above-mentioned alcohols or any monoalcohol with any of the commercially available esters (e.g., diethylmalonate). For example, diethyl malonate may be reacted with 2-ethylhexanol to obtain the bis-(2-ethylhexyl)-malonate. It is also possible to use mixtures of alcohols to obtain the corresponding mixed malonic or alkylmalonic acid esters. Suitable alkylmalonic acid esters include: butyl malonic acid diethylester, diethyl ethyl malonate, diethyl butyl malonate, diethyl isopropyl malonate, diethyl phenyl malonate, diethyl n-propyl malonate, diethyl isopropyl malonate, dimethyl allyl malonate, diethyl chloromalonate, and dimethyl chloro-malonate.

Other isocyanate blocking agents are described in, for example, U.S. Pat. Nos. 6,288,176, 5,559,064, 4,637,956, 4,870,141, 4,767,829, 5,108,458, 4,976,833, and 7,157,527, U.S. Patent Application Publication Nos. 20050187314, 20070023288, 20070009750, 20060281854, 20060148391, 20060122357, 20040236021, 20020028932, 20030194635, and 20030004282, each of which is incorporated herein by reference. Mixtures of the above-listed isocyanate blocking agents may also be used.

Blocked polyisocyanate compounds may include, for example, polyisocyanates having at least two tree isocyanate groups per molecule, where the isocyanate groups are blocked with an above-described isocyanate blocking agent.

Blocked isocyanates may be prepared by reaction of one of the above-mentioned isocyanate compounds and a blocking agent by a conventionally known appropriate method.

In other embodiments, the blocked isocyanates used in embodiments disclosed herein may be any isocyanate where the isocyanate groups have been reacted with an isocyanate blocking agent so that the resultant capped isocyanate is stable to active hydrogens at room temperature but reactive with active hydrogens at elevated temperatures, such as between about 65° C. to 200° C.

Blocked polyisocyanate compounds are typically stable at room temperature. When heated to a temperature about the minimum unblocking temperature, the blocking agent is dissociated to regenerate the free isocyanate groups, which may readily react with hydroxyl groups of the organic polyol compounds.

As an alternative to an external or conventional blocking agent, the isocyanates of the present disclosure may be internally blocked. The term internally blocked, as used herein, indicates that there are uretdione groups present which unblock at certain temperatures to free the isocyanate groups for cross-linking purposes. Isocyanate dimers (also referred to as uretdiones) may be obtained by dimerizing diisocyanates in the presence of phosphine catalysts. In certain embodiments, the blocking agent is selected from the group consisting of: methylethylcetoxime (MEKO), diethyl malonate (DEM), 3,5-dimethylpyrazole (DMP).

Organic Polyol Component

According to the embodiments, the organic polyol component may comprise one or more types of organic polyol compounds, which are reactive with the isocyanate compounds. Organic polyol compounds suitable for use in the present invention may include, but are not limited to, polyether polyols, polyester polyols, polycarbonate polyols, and biorenewable polyols. Such polyols may be used alone or in suitable combination as a mixture.

General functionality of polyols used in the present invention is between about 2 to about 5, or about 2 to about 3. The weight average molecular weight of polyols may be between about 500 and about 10,000, or about 500 and about 5,000 g/mol.

The proportion of the organic polyol compounds is generally of between about 10 and about 80% by weight, preferably between about 20 and about 50% based of the expandable polymer grout system.

Polyether polyols for use in the present invention include alkylene oxide polyether polyols such as ethylene oxide polyether polyols and propylene oxide polyether polyols and copolymers of ethylene and propylene oxide with terminal hydroxyl groups derived from polyhydric compounds, including diols and triols; for example, ethylene glycol, propylene glycol, 1,3-butane diol, 1,4-butane diol, 1,6-hexane diol, neopentyl glycol, diethylene glycol, dipropylene glycol, pentaerythritol, glycerol, diglycerol, trimethylol propane, and similar low molecular weight polyols.

Polyester polyols for use in the present invention include, but are not limited to, those produced by reacting a dicarboxylic acid with an excess of a diol, for example, adipic acid with ethylene glycol or butanediol, or reaction of a lactone with an excess of a diol such as caprolactone with propylene glycol. In addition, polyester polyols for use in the present invention may also include: linear or lightly branched aliphatic (e.g. adipates) polyols with terminal hydroxyl group; low molecular weight aromatic polyesters; polycaprolactones; polycarbonate polyol. Those linear or lightly branched aliphatic (e.g. adipates) polyols with terminal hydroxyl group are produced by reacting a dicarboxyl acids with an excess of diols, triols and their mixture; those dicarboxyl acids include, but are not limited to, for example, adipic acid, AGS mixed acid; those diols, triols include, but are not limited to, for example, ethylene glycol, diethylene glycol, propylene glycol, dipropylene glycol, 1,4-butane diol, 1,6-hexane diol, glycerol, trimethylolpropane and pentaerythritol.

In certain embodiments, the organic polyol component is selected from aromatic polyester polyol and an aliphatic polyester polyol.

The aromatic polyester polyol is typically formed via the condensation of a glycol and a dicarboxylic acid or acid derivative. The functionality, structure, and molecular weight of the polyester polyol can be varied to tailor the processing characteristics and physical properties of the expanded polymer grout system to a particular application. In certain embodiments, the aromatic polyester polyol has a functionality of greater than 2 or about 2 to about 5 and a weight-average molecular weight of from 500 to 5,000 g/mol, or about 1,000 to 3,000 g/mol. In certain embodiments, the aromatic polyester polyol has a hydroxyl value of from 100 to 500 mg KOH/g. In certain embodiments, the aromatic polyester polyol has a viscosity at 25° C. of from about 25 cP to 500 cP, more preferably in the range of 25 cP to 200 cP, and even more preferably in the range of 25 cP to 100 cP. In certain embodiments, the aromatic polyester polyol has a specific gravity of about 1.0 to about 1.2 g/cm$^3$. In certain embodiments, the aromatic polyester polyol is present in the organic polyol component in an amount of from about 25 to about 100 parts by weight, based on 100 parts by weight of the total weight of the polyols present in the organic polyol component.

The aliphatic polyester polyol is typically formed via the condensation of a glycol and a dicarboxylic acid or acid derivative. In certain embodiments, the aliphatic polyester polyol has a functionality of greater than 2 or about 2 to about 5 and a weight-average molecular weight of from 500 to 5,000 g/mol, or about 1,000 to 3,000 g/mol. In certain embodiments, the aliphatic polyester polyol has a hydroxyl value of from 20 to 400 mg KOH/g. In certain embodiments, the aliphatic polyester polyol has a viscosity at 25° C. of from about 25 cP to 500 cP, more preferably in the range of 25 cP to 200 cP, and even more preferably in the range of 25 cP to 100 cP. In certain embodiments, the aliphatic polyester polyol has a specific gravity of about 1.0 to about 1.2 g/cm$^3$. In certain embodiments, the aliphatic polyester polyol is present in the organic polyol component in an amount of from about 2 to about 100 parts by weight, based on 100 parts by weight of the total weight of the polyols present in the organic polyol component.

In certain embodiments, one or more aliphatic polyester polyol and one or more aromatic polyester polyol are both present in the organic polyol component, for example in a ratio of from 1:5 to 1:15.

Polycarbonate polyols are derived from carbonic acid that can be produced through the polycondensation of diols with phosgene, although transesterification of diols, commonly hexane diol, with a carbonic acid ester, such as diphenylcarbonate.

Biorenewable polyols suitable for use in the present invention include castor oil, sunflower oil, palm kernel oil, palm oil, canola oil, rapeseed oil, soybean oil, corn oil, peanut oil, olive oil, algae oil, and mixtures thereof.

Blowing Agents, Catalysts and Other Auxiliary Components

Typically, the isocyanate component and the organic polyol component are reacted in the presence of a blowing agent to form the expandable polymer grout. The blowing agent may be a physical blowing agent, a chemical blowing agent, or a combination of a physical blowing agent and a chemical blowing agent.

The term "physical blowing agent" refers to blowing agents that do not chemically react with the isocyanate and/or the organic polyol component. The physical blowing agent can be a gas or liquid. The liquid physical blowing agent typically evaporates into a gas when heated, and typically returns to a liquid when cooled. Examples of physical blowing agents include volatile liquids such as chlorofluorocarbons, partially halogenated hydrocarbons or non-halogenated hydrocarbons like propane, n-butane, isobutane, n-pentane, isopentane cyclopentane and/or neopentane. In a particular embodiment, the blowing agent comprises, or consists essentially of, cyclopentane.

The term "chemical blowing agent" describes blowing agents which chemically react with the isocyanate or with other components to release a gas for foaming. Examples of chemical blowing agents include water, gaseous compounds such as nitrogen or carbon dioxide, gas (e.g. CO2) forming compounds such as azodicarbonamides, carbonates, bicarbonates, citrates, nitrates, borohydrides, carbides such as alkaline earth and alkali metal carbonates and bicarbonates e.g. sodium bicarbonate and sodium carbonate, ammonium carbonate, diaminodiphenylsulphone, hydrazides, malonic acid, citric acid, sodium monocitrate, ureas, azodicarbonic methyl ester, diazabicyclooctane and acid/carbonate mixtures. In a particular embodiment, the blowing agent comprises, or consists essentially of, water.

In certain embodiments, the total amount of the blowing agents present in the reaction mixture or in the organic polyol component in an amount of from about 1 to about 30, or about 10 to about 25, parts by weight, based on 100 parts by weight of the organic polyols present in the organic polyol component.

In one embodiment, the expandable polymer grout system comprises a physical blowing agent. In one embodiment, the expandable polymer grout system comprises a chemical blowing agent. In one embodiment, the expandable polymer grout system comprises both a physical blowing agent and a chemical blowing agent.

In one embodiment, the expandable polymer grout system comprises one or more catalysts. In certain embodiments, the one or more catalysts are present in the organic polyol component to catalyze the reaction between the isocyanate and the polyols. The catalyst may include any suitable catalyst or mixtures of catalysts known in the art. Examples of suitable catalysts include, but are not limited to, gelation catalysts, e.g., amine catalysts in dipropylene glycol; blowing catalysts, e.g., bis(dimethylaminoethyl) ether in dipropylene glycol; and metal catalysts, e.g., tin, bismuth, lead, etc. One non-limiting example of a suitable catalyst is N,N-dimethylcyclohexylamine.

In one embodiment, the expandable polymer grout system comprises one or more surfactants. The surfactant typically supports homogenization of the blowing agent and the polyol and regulates a cell structure of the expandable polymer grout. In certain embodiments, the one or more surfactants are present in the organic polyol component. The surfactant may include any suitable surfactant or mixtures of surfactants known in the art. Non-limiting examples of suitable surfactants include various silicone surfactants, salts of sulfonic acids, e.g. alkali metal and/or ammonium salts of oleic acid, stearic acid, dodecylbenzene- or dinaphthylmethane-disulfonic acid, and ricinoleic acid, foam stabilizers such as siloxaneoxyalkylene copolymers and other organopolysiloxanes, oxyethylated alkyl-phenols, oxyethylated fatty alcohols, paraffin oils, castor oil, castor oil esters, and ricinoleic acid esters, and cell regulators, such as paraffins, fatty alcohols, and dimethylpolysiloxanes. One specific, non-limiting example of a surfactant is a silicone-polyether block copolymer.

The expandable polymer grout system, or organic polyol component, may optionally include one or more additional auxiliary components. Suitable additives for purposes of the instant disclosure include, but are not limited to, chain-extenders, crosslinkers, chain-terminators, processing additives, adhesion promoters, anti-oxidants, defoamers, anti-foaming agents, water scavengers, molecular sieves, fumed silicas, ultraviolet light stabilizers, fillers, thixotropic agents, silicones, colorants, inert diluents, plasticizers, silane coupling agent, cell stabilizers, fillers, or any combination thereof.

In one embodiment, the proportion of the auxiliary components present in the expandable grout composition is between about 5 and about 80 percent by weight, or about 10 and about 60 percent by weight, of the total weight of the expandable polymer grout system.

In certain embodiments, the two component systems have the isocyanate delivered as an isolated component (not combined with other reactants or additives) and the organic polyol component may be pre-blended with blowing agents, catalysts and other auxiliary components, as described above.

In certain embodiments, the performance properties of the expandable polymer grout system may be adjusted through the addition of the blowing agents, catalysts and auxiliary components.

In certain embodiments, it may be desirable to combine or mix the expandable polymer grout system with other functional materials, such as fluid-loss control particulates to mitigate premature or excessive loss of the liquid polymer into the formation or annulus prior to the polymer setting up or crosslinking in the desired locations. In certain embodiments, the expandable polymer grout system may be combined with cement such as to enhance certain properties of the cement. Combinations with materials such as cement may provide enhanced material properties for operations such as forming an improved seal along a sand screen. Prior to the polymer crosslinking or otherwise reacting, the disclosed polymers may exhibit flow properties that are more Newtonian and less viscous than liquid cement, thereby flowing into tighter flowpaths than cement alone otherwise might.

Methods of Use

The expandable polymer grout system according to the embodiments described herein may be deployed or injected downhole to form a polymer seal along one or more of a sand screen, the annulus surrounding the sand screen, and the formation face surrounding the sand screen. Methods of deployment downhole will depend on both the characteristics and reactivity of the expandable polymer grout system as well as the intended usage downhole. In certain embodiments, the expandable polymer grout system is injected into the screen, annulus, and also wellbore adjacent to the target location for treatment. In certain embodiments, after curing of the injected expandable polymer grout system, the wellbore portion of the plugging material may be milled out mechanically, leaving cured polymer seal in the screen and annulus.

In certain embodiments, a method for creating a polymer seal along a sand screen within a wellbore from an expandable polymer grout system, comprises:

(I) providing an expandable polymer grout system to a target location within or through a wellbore, wherein the expandable polymer grout system comprises: (i) an isocyanate component comprising one or more isocyanate compounds; and (ii) an organic polyol component comprising one or more organic polyol compounds; in the presence of (iii) one or more blowing agents;

(II) combining components (i), (ii) and (iii) of the expandable polymer grout system to facilitate the polymerization reaction to form the expandable polymer grout at the target location; and (III) allowing the expandable polymer grout to cure at the target location thereby sealing a sand screen. In certain embodiments, one or more polymer seals formed from the system according to the embodiments may be formed at targeted sites or zones. For example, a polymer seal formed from the systems according to the embodiments may be set at a target location or target zone of a specific depth in a well, rather than filling the well. To provide sealing at a specific depth, spotting of the polyurethane precursors may be deployed using coiled tubing, coiled hose (s), custom umbilical, or other conduit to target the solution placement, optionally with packers for isolation.

In certain embodiments, the isocyanate component and organic polyol component are injected through a form of dual-string injection, where each component is injected through an isolated tube, are combined optionally in a mixing chamber placed at the target interval (optionally between packers or other barriers), and the combined precursors are then injected from the mixing chamber into a section of sand screen and at least a portion of the annular volume surrounding the section of sand screen. This injection will be followed by a static curing time, to allow the expandable polymer to first expand and then to cure into the fully polymerized (optionally hardened) state. The curing may optionally be carried out under additional pressure applied by a working fluid through both the workstring and/or the annulus (possibly to control the degree of expansion and/or density or to further squeeze the precursor blend into the annulus). Injection of the precursors through the mixing chamber may optionally be followed by a flush stage of an inert fluid or gas (that does not participate in the polymerization/curing process) prior to expansion and curing to purge and clean the mixing chamber.

In certain embodiments, the isocyanate and polyol components of the expandable polymeric grout are injected into the well or wellbore separately.

In certain embodiments, the components of the expandable polymer grout are injected into the hydrocarbon well through dual-string injection or through isolated tubes.

In certain embodiments, the components of the expandable polymer grout are combined in a mixing chamber prior to injection into the region in which a polymer seal is to be formed.

The expandable polymer grout system can be used in methods of creating polymer seals in a screen, screen-annulus, or formation adjacent to the screen annulus. In certain embodiments, the method for creating polymer seals within a screen or annulus comprises: (I) providing an expandable polymer grout system to a target location, wherein the expandable polymer grout system comprises: (i) an isocyanate component comprising one or more isocyanate compounds; and (ii) an organic polyol component comprising one or more organic polyol compounds; in the presence of (iii) one or more blowing agents; (II) combining components (i), (ii) and (iii) of the expandable polymer grout system to facilitate the polymerization reaction to form the expandable polymer grout at the target location and (III) allowing the expandable polymer grout to cure at the target location to form the polymer seal.

In certain embodiments, the initial combining of the components may be conducted at the surface of the well, prior to being pumped into the wellbore, while in other embodiments the components will be combined inside the wellbore. In certain embodiments, the target location is at an open hole location within the wellbore where no casing is present. In alternate embodiments, the target location is at a cased section within the wellbore (not shown). In certain embodiments, the target location is at a location accessed through the wellbore. The polymer seal forms a barrier along the sand screen to inhibit the flow of solids (e.g., sand, gravel, proppant) from the formation and/or annulus through the sand screen.

In certain embodiments, the method comprises creating a polymer seal along a sand screen within a wellbore during at least one of a drilling operation, a casing operation, a liner operation, a completion operation, a recompletion operation, a primary cementing operation, a staged cementing operation, a production operation, or an injection operation.

Examples of Deploying Expandable Polymer Grout in Well Systems

FIGS. 1 through 6 illustrate examples of well systems in which the previously described expandable polymer grout systems can be applied to seal a sand screen. The examples of FIGS. 1 through 6 illustrate various methods for deploying an expandable polymer grout system in a wellbore. The well systems of FIGS. 1 through 6 are illustrative examples and the polymer grout described herein can be applied to sand screens in well systems with other configurations as well. Moreover, the different methods illustrated in FIGS. 1 through 6 are not mutually exclusive in that one of skill in this field will understand that aspects of one method may be combined with aspects of another method illustrated in the figures. The well systems illustrated in FIGS. 1 through 6 are not drawn to scale so that more relevant aspects of the disclosure may be more clearly illustrated.

Figure 2:
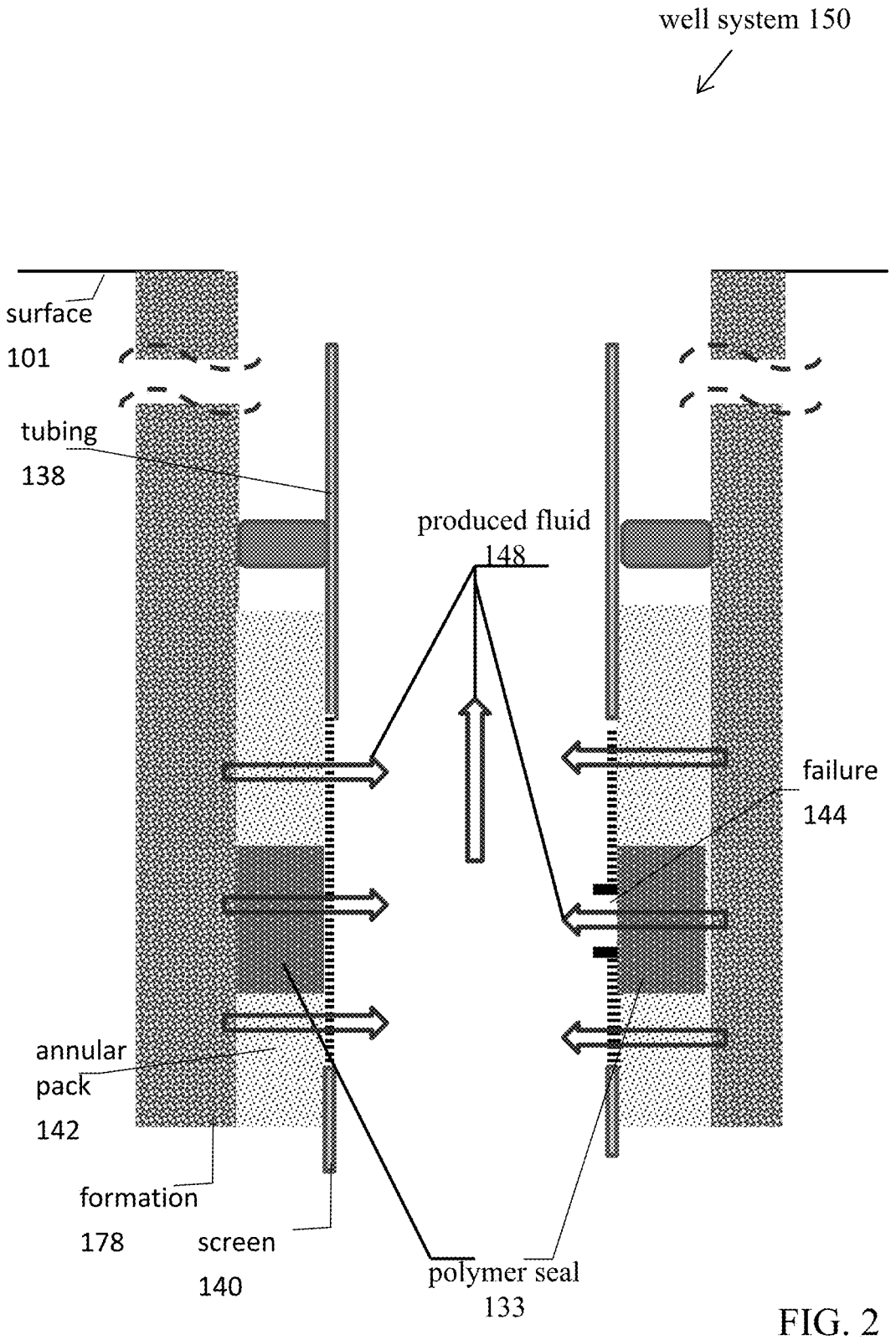
FIG. 2 is a sectional view drawing of the well system of FIG. 1 after the polymer seal has been placed at the failure point in the sand screen in accordance with the example embodiments described herein.

Referring to FIGS. 1 and 2, well system 150 in formation 178 is illustrated. The well system 150 includes an open hole wellbore with a wellbore opening at surface 101. Well system 150 includes a sand screen 140 having a generally cylindrical shape. The sand screen 140 is attached to a cylindrical tubing 138, such as a work string or production tubing, that would extend from the surface 101 to a depth of the wellbore at which the sand screen 140 is positioned. An annular pack 142 is located in the annular space between the outer surface of the cylindrical sand screen 140 and the formation 178. As examples, the annular pack 142 may be a gravel pack or proppant pack.

The purpose of the sand screen 140 is to prevent solids from flowing into the sand screen and up through tubing 138. However, sand screen 140 has a failure point 144 located along the sand screen 140. The failure point 144 is a point at which the perforated section of the sand screen 140 has been damaged allowing solids to flow from the annular space through the failure point 144 in the sand screen 140 and up through the tubing 138. The damage to the sand screen 140 may have been caused by a void in the annular pack 142 that allowed solids to flow into and erode the perforated section of the sand screen. The failure point 144 may be identified when solids are produced to the surface of the well. Additionally, the failure point 144 can be detected via data gathered in a production log or temperature log for the well.

To repair the failure point 144 in the sand screen 140, a deployment system 122 can be inserted into the well system 150 to place an expandable polymer grout system at a target location 134 adjacent to the failure point 144. Once deployed at the target location 134, the expandable polymer grout system expands into a grout that cures to form a polymer seal at the failure point 144 in the sand screen 140.

More specifically, the method begins with identifying the failure point 144 in the sand screen 140. Once identified, the deployment system 122 can be used to deploy an expandable polymer grout system at a target location 134 adjacent to the failure point 144. However, the reactions between most polyurethane precursors are often so rapid that mixing the components of the expandable polymer grout system at the surface and injecting them downhole to the target location would likely be unsuccessful as the grout expansion would likely occur before reaching the target location. Accordingly, the deployment system 122 is directed to placing the expandable polymer grout system at the target location and within the required time to allow the expandable polymer grout system to expand and cure into the polymer seal at the sand screen 140.

Optionally, in connection with inserting the deployment system 122 into the well system 150, barriers 146 can be used to isolate the failure point 144. Specifically, a lower barrier can be placed within the sand screen 140 below the failure point 144 and an upper barrier can be placed within the sand screen 140 above the failure point 144. The upper and lower barriers can be any of a variety of barriers used in well completions including a bridge plug, packer, cement retainer, or other physical barrier. The purpose of the upper and lower barriers is to prevent the expandable polymer grout system from flowing away from the failure point 144 before curing sets the polymer seal. In alternate embodiments of the deployment system 122, the upper and/or lower barrier may be unnecessary.

Once the upper and lower barriers are in place in the well system, the deployment system 122 can be inserted into the well system. The deployment system 122 can have a variety of configurations. The example deployment system 122 of FIG. 1 includes a first conduit 106 that delivers an isocyanate component through the wellbore to a mixer 120. The isocyanate flows from a tank 102 and is pumped via a pump 104 through the first conduit 106. A check valve at the end of the first conduit 106 controls the flow of the isocyanate into the mixer 120. The example system of FIG. 1 also includes a second conduit 114 that delivers an organic polyol component through the wellbore to the mixer 120. The organic polyol component flows from a tank 110 and is pumped via a pump 112 through the second conduit 114. While the first conduit 106 and second conduit 114 are illustrated as separated components in FIG. 1, in other examples they may be combined into a single tubular and may be concentrically aligned. A check valve at the end of the second conduit 114 controls the flow of the organic polyol component into the mixer 120. As explained previously, the organic polyol component may be pre-blended with blowing agents, catalysts, and other auxiliary components before the component it pumped into the wellbore via pump 112. The tanks 102 and 110 can be stationary tanks located at the surface 101 of the well system 150 or can be mobile tanks mounted on vehicles.

In certain example embodiments, the mixer 120 with the attached first conduit 106 and attached second conduit 114 can be raised and lowered into the wellbore by an optional support line 118 or on a tubular string. In the example illustrated in FIG. 1, the mixer 120 is a static mixer with helical internal surfaces that mix the isocyanate component and the organic polyol component as they flow into the mixer 120 from the first conduit 106 and the second conduit 114. As the isocyanate component and the organic polyol component of the expandable polymer grout system combine within the mixer, they react and form the grout 132. The grout exits the mixer 120 through an outlet at the bottom of the mixer 120 and flows into a tailpipe 130 attached to the bottom of the mixer 120. As illustrated in the example of FIG. 1, the tailpipe 130 preferably has a vertical segment and a generally horizontal segment that directs the grout toward the failure point 144. In certain embodiments, the tailpipe 130 can include apertures that direct the grout towards the failure point 144. The shape of the tailpipe and the positions of the apertures can be modified to accurately direct the grout to the desired target location. In certain embodiments, the deployment system 122 can include a fluid to apply pressure to deploy the grout 132 at the target location 134.

An advantage of the deployment system 122 illustrated in FIG. 1 is that the expandable polymer grout system components are mixed proximate to the target location 134 and flow to the failure point 144 before the grout cures and forms a hardened polymer seal along the sand screen 140. As non-limiting examples, it is preferred that the components of the expandable polymer grout system are mixed within the wellbore and within a distance of 50 feet from the target location 134, more preferably within 40 feet of the target location 134, and still more preferably within 30 feet of the target location 134. The components of FIG. 1 are not drawn to scale. Nonetheless, as one example, the height of the mixer 120 can be between 8 and 20 inches and the height of the tailpipe 130 can be between 5 feet and 30 feet. Taking into account these typical dimensions and the speed of the pumps 104 and 112, the mixture can be combined at the mixer 120 and flow through the tailpipe 130 to the target location 134 within a few minutes so that the grout is in the desired position before it hardens.

As the grout 132 flows out of the tailpipe 130 to the target location 134, the support line 118 can be used to retract the mixer 120 and the attached tailpipe 130 and conduits 106, 114 from the wellbore. The rate at which the components are pumped through the conduits can be equal to the rate at which the mixer 120 and its attached components are retracted from the wellbore so that the mixer 120 and tailpipe 130 maintain a generally uniform distance from the target location 134 as the grout accumulates in the target location 134. Retracting the mixer 120, tailpipe 130 and conduits 106, 114 can prevent interference with the expansion and curing of the grout 132.

FIG. 2 illustrates the well system 150 of FIG. 1 after the deployment system 122 has been removed from the well system 150. As shown in FIG. 2, the grout has expanded through the sand screen 140 into the annular pack 142 and has cured to form the polymer seal 133. The expanding characteristic of the grout 132 is an advantage in that it surrounds the failure point 144 and fills voids in the annular pack 142 adjacent to the failure point 144. The polymer seal 133 covers the failure point 144 in the screen, thereby preventing the flow of solids into the sand screen. In certain embodiments, the polymer seal 133 may extend radially through a portion of the annular pack 142 toward the formation 178. In other embodiments, the volume of the expandable polymer grout system may be configured so that it expands to form a polymer seal that extends radially from the sand screen 140, through the entirety of the annular pack 142, and to the formation 178.

In certain embodiments, the components of the expandable polymer grout system are selected to form a closed cell polymer seal that is impermeable to solids as well as fluids that may flow from the formation 178. Thus, the closed cell polymer seal prevents further production of fluids from the interval of the formation at which the closed cell polymer seal is located. However, intervals above and below polymer seal remain capable of producing fluids from the formation into the sand screen 140.

In contrast, in other embodiments, the components of the expandable polymer grout system are selected to form an open cell polymer seal 133 that blocks the flow of solids into the sand screen 140, but that is permeable to production of fluids (e.g., hydrocarbon fluids) and/or gas (e.g., methane). An open cell polymer seal 133 is illustrated in FIG. 2. As shown in FIG. 2, a produced fluid 148 from the formation 178 can flow through the open cell polymer seal 133 and into the sand screen 140. FIG. 2 also shows the produced fluid 148 flowing into the sand screen 140 at intervals above and below the polymer seal 133 where no failure points are present in the sand screen 140. After flowing into the sand screen 140, the produced fluid 148 flow up through the wellbore to the surface 101.

Figure 3:
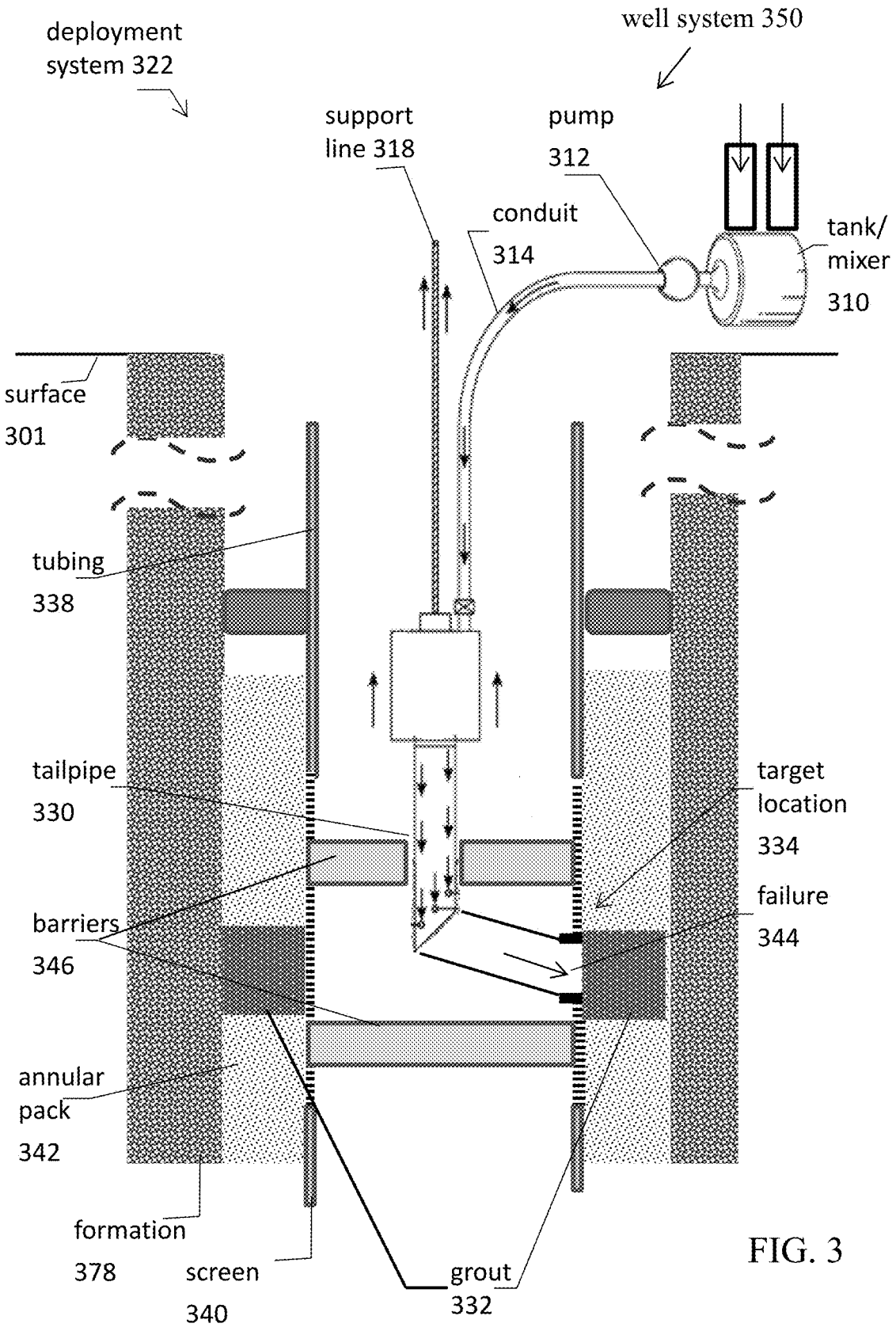
FIG. 3 is a sectional view drawing of another well system illustrating a method of placing a polymer seal at a failure point in a sand screen in accordance with the example embodiments described herein.
Figure 4:
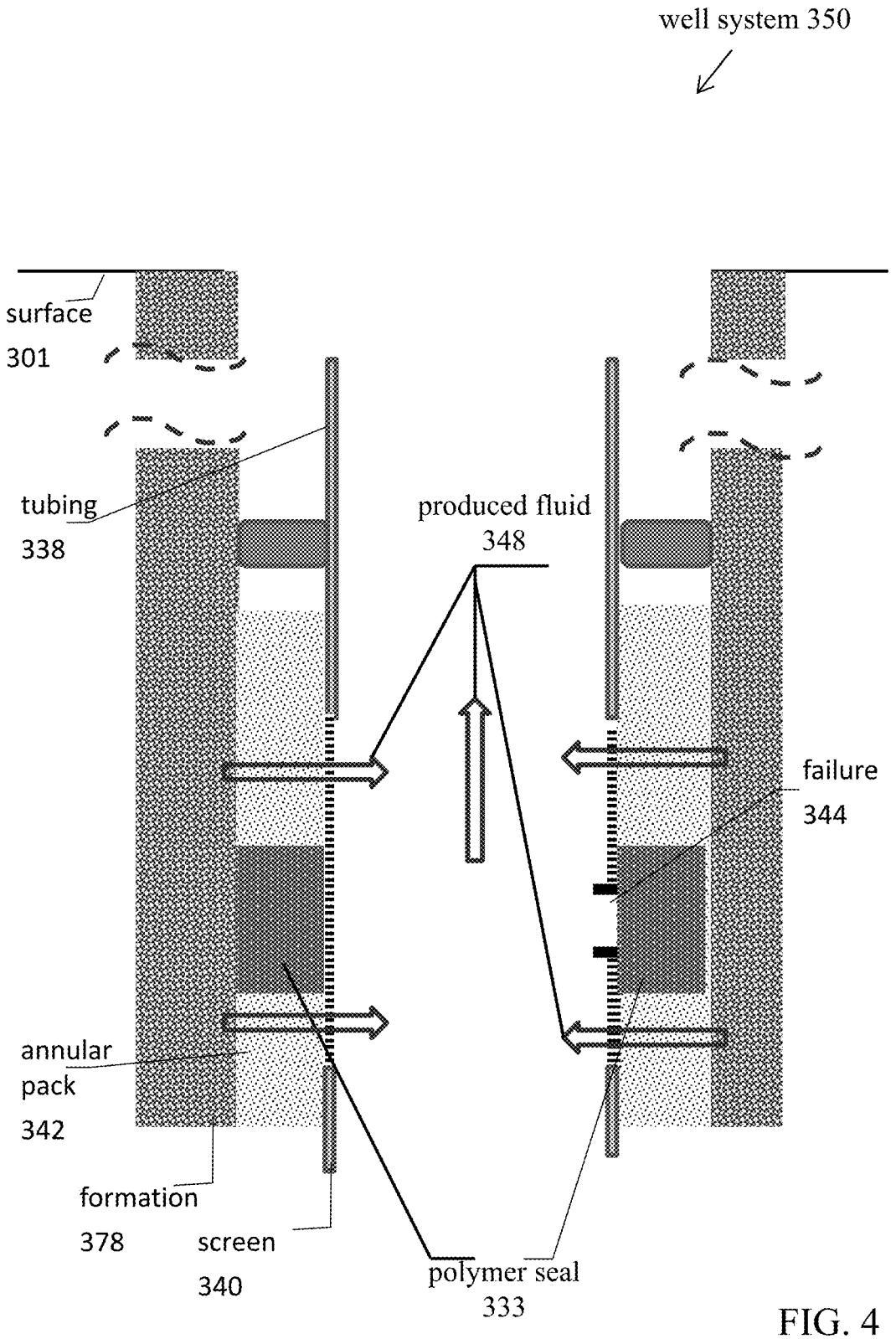
FIG. 4 is a sectional view drawing of the well system of FIG. 3 after the polymer seal has been placed at the failure point in the sand screen in accordance with the example embodiments described herein.

Referring now to FIGS. 3 and 4, an example of another well system 350 in formation 378 is illustrated. Similar to the well system of FIGS. 1 and 2, well system 350 includes an open hole wellbore with a wellbore opening at surface 301. Well system 350 includes a sand screen 340 having a generally cylindrical shape. The sand screen 340 is attached to a cylindrical tubing 338, such as a work string or production tubing, that would extend from the surface 301 to a depth of the wellbore at which the sand screen 340 is positioned. An annular pack 342 is located in the annular space between the outer surface of the cylindrical sand screen 340 and the formation 378. As examples, the annular pack 342 may be a gravel pack or proppant pack.

Sand screen 340 prevents solids from flowing into the sand screen and up through tubing 338. However, sand screen 340 has a failure point 344 located along the sand screen 340. The failure point 344 is a point at which the perforated section of the sand screen 340 has been damaged allowing solids to flow from the annular space through the failure point 344 in the sand screen 340 and up through the tubing 338. The damage to the sand screen 340 may have been caused by a void in the annular pack 342 that allowed solids to flow into and erode the perforated section of the sand screen. The failure point 344 may be identified when solids are produced to the surface of the well. Additionally, the failure point 344 can be detected via data gathered in a production log or temperature log for the well.

To repair the failure point 344 in the sand screen 340, a deployment system 322 can be inserted into the well system 350 to place an expandable polymer grout system at a target location 334 adjacent to the failure point 344. Once deployed at the target location 334, the expandable polymer grout system expands into a grout that cures to form a polymer seal at the failure point 344 in the sand screen 340.

More specifically, the method begins with identifying the approximate failure point 344 in the sand screen 340. In instances where there is uncertainty as to the exact location of the failure point, the failure point may be identified as a range of depths and the identified range can be treated using the methods described herein. Once identified, the deployment system 322 can be used to deploy an expandable polymer grout system at a target location 334 adjacent to the failure point 344.

Optionally, in connection with inserting the deployment system 322 into the well system 350, barriers 346 can be used to isolate the failure point 344. Specifically, a lower barrier can be placed within the sand screen 340 below the failure point 344 and an upper barrier can be placed within the sand screen 340 above the failure point 344. The upper and lower barriers can be any of a variety of barriers used in well completions including a bridge plug, packer, cement retainer, or other physical barrier. The purpose of the upper and lower barriers is to prevent the expandable polymer grout system from flowing away from the failure point 344 before curing sets the polymer seal. In alternate embodiments of the deployment system 322, the upper and/or lower barrier may be unnecessary.

Once the upper and lower barriers are in place in the well system, the deployment system 322 can be inserted into the well system. The deployment system 322 can have a variety of configurations. The example deployment system 322 of FIG. 3 differs from the previous deployment system in that the isocyanate component and the organic polyol component of the expandable polymer grout system are mixed in a mixer 310 located at the surface 301 of the well system 350. As explained previously, the organic polyol component may be pre-blended with blowing agents, catalysts, and other auxiliary components. The example of FIG. 3 may be appropriate for an expandable polymer grout system that requires more time to expand and to cure into a hardened polymer seal.

At the time of deployment, the mixer 310 can combine the isocyanate component and the organic polyol component, which components react and form the grout 332. The grout 332 can be directed from the mixer 310 to a pump 312 that directs the grout down a conduit 314. A bottom portion of the deployment system 322 can be lowered into and raised from the wellbore by a support line 318 or a tubular string. At the base of the deployment system 322, the grout 332 flows into a tailpipe 330. The tailpipe 330 can have a variety of configurations. In the example of FIG. 3, the tailpipe 330 has a vertical segment and a generally horizontal segment. The tailpipe directs the grout 332 to the failure point 344 in the sand screen 340 that is located at the target location 334. As the grout 332 expands it passes through the sand screen 340 and encases the failure point 344.

FIG. 4 illustrates the well system 350 of FIG. 3 after the deployment system 322 has been removed from the well system 350. As shown in FIG. 4, the grout has expanded through the sand screen 340 into the annular pack 342 and has cured to form the polymer seal 333. The expanding characteristic of the grout 332 is an advantage in that it surrounds the failure point 344 and fills voids in the annular pack 342 adjacent to the failure point 344. The polymer seal 333 covers the failure point 344 in the screen, thereby preventing the flow of solids into the sand screen. In certain embodiments, the polymer seal 333 may extend radially through a portion of the annular pack 342 toward the formation 378. In other embodiments, the volume of the expandable polymer grout system may be configured so that it expands to form a polymer seal that extends radially from the sand screen 340, through the entirety of the annular pack 342, and to the formation 378.

As described in connection with FIGS. 1 and 2, the components of the expandable polymer grout system can be selected to form a polymer seal that is either permeable to fluids or impermeable to fluids. In the example illustrated in FIG. 4, the polymer seal 333 is a closed cell (impermeable) polymer that prevents fluids from flowing through the seal. Accordingly, after the failure point 344 has been treated to form the impermeable polymer seal 333, fluids are only produced from interval above and below the polymer seal 333. The produced fluids 348 flow through the portions of the sand screen 340 that have not been sealed with the polymer seal 333.

Figure 5:
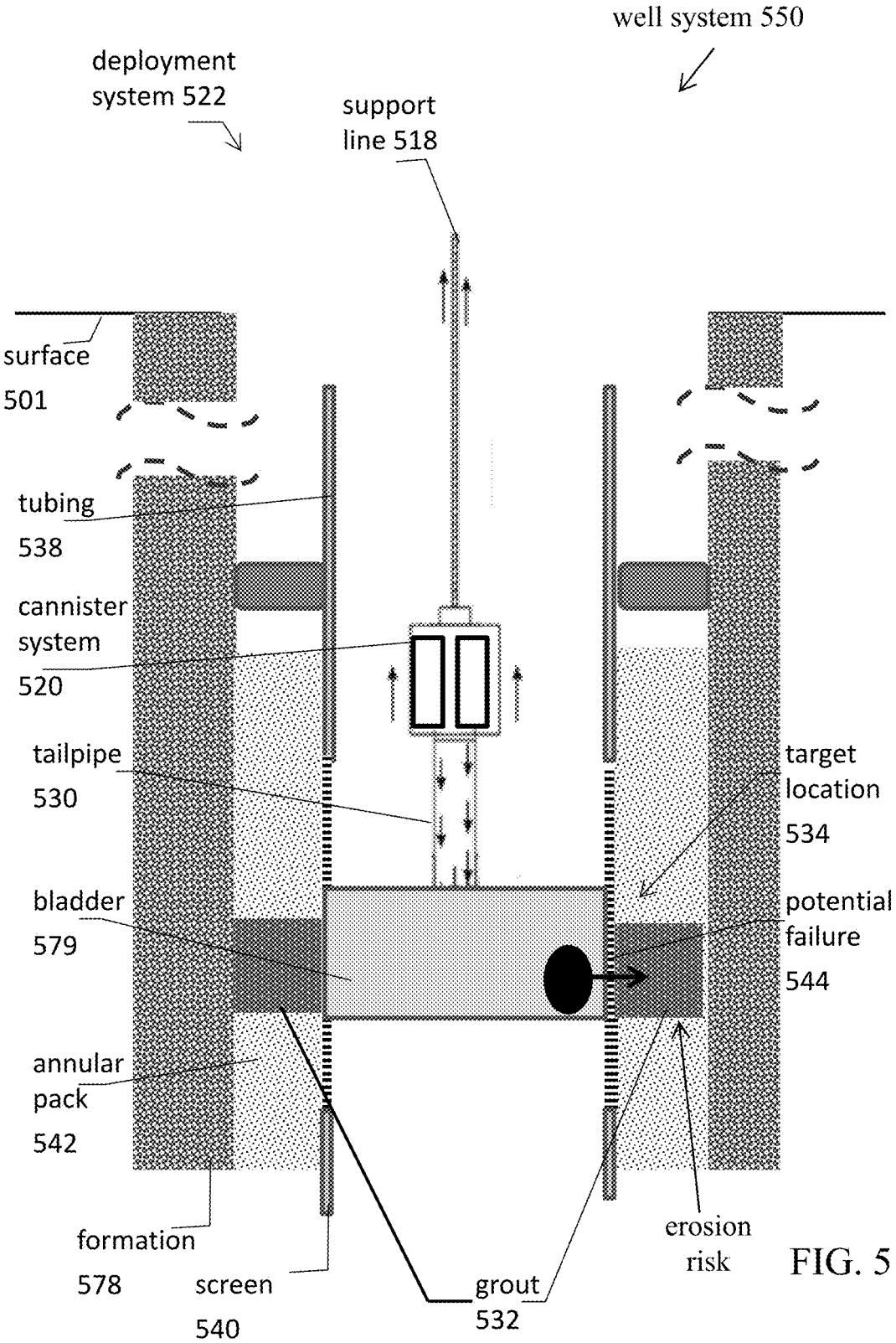
FIG. 5 is a sectional view drawing of another well system illustrating a method of placing a polymer seal at a potential failure point in a sand screen in accordance with the example embodiments described herein.
Figure 6:
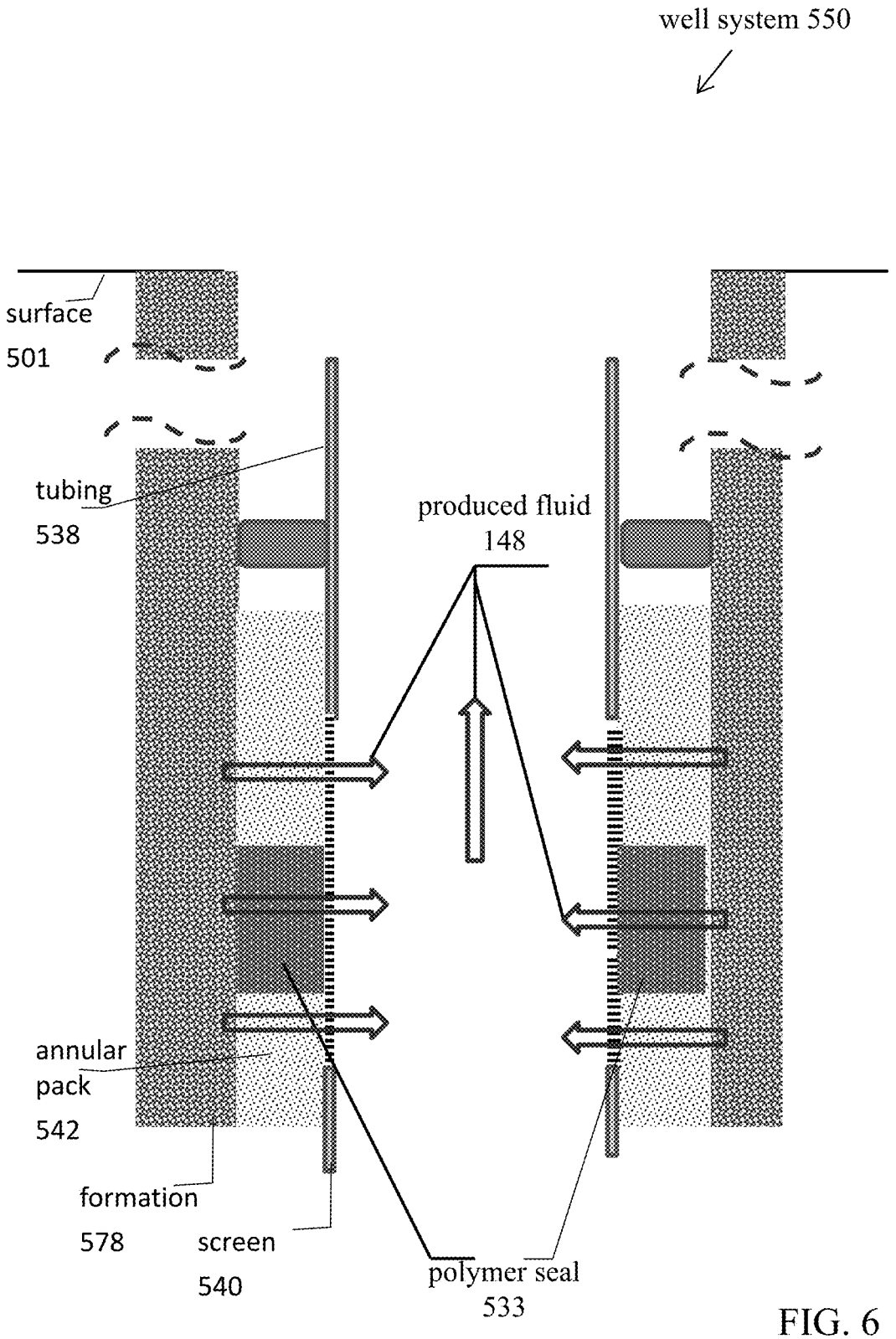
FIG. 6 is a sectional view drawing of the well system of FIG. 5 after the polymer seal has been placed at the potential failure point in the sand screen in accordance with the example embodiments described herein.

Referring now to FIGS. 5 and 6, an example of another well system 550 in formation 578 is illustrated. Similar to the well system of FIGS. 1-4, well system 550 includes an open hole wellbore with a wellbore opening at surface 501. Well system 550 includes a sand screen 540 having a generally cylindrical shape. The sand screen 540 is attached to a cylindrical tubing 538, such as a work string or production tubing, that would extend from the surface 501 to a depth of the wellbore at which the sand screen 540 is positioned. An annular pack 542 is located in the annular space between the outer surface of the cylindrical sand screen 540 and the formation 578. As examples, the annular pack 542 may be a gravel pack or proppant pack.

Sand screen 540 prevents solids from flowing into the sand screen and up through tubing 538. However, a potential failure point 544 in the sand screen 540 has been identified. The potential failure point 544 located along the sand screen 540. There may be a variety of reasons a point along the sand screen 540 is identified as a potential failure point 544. For example, a void may be present in the annular pack 542 adjacent to the potential failure point 544. The presence of a void in the annular pack 542 may cause a greater amount of solids to impact the sand screen at the potential failure point 544 ultimately causing a failure in the sand screen. Other factors that may cause a point on the sand screen to be identified as a potential failure point may relate to the type of formation or the type of fluids and solids produced from the formation that may increase the likelihood of a failure occurring in the sand screen 540.

To reduce the likelihood of a failure occurring at the identified potential failure point 544, that portion of the sand screen can be treated with the expandable polymer grout systems previously described herein. A deployment system 522 can be inserted into the well system 550 to place an expandable polymer grout system at a target location 534 adjacent to the potential failure point 544. Once deployed at the target location 534, the expandable polymer grout system expands into a grout that cures to form a polymer seal at the potential failure point 544 in the sand screen 540.

The deployment system 522 can have a variety of configurations. The example deployment system 522 of FIG. 5 differs from the previous deployment system in that it includes a canister system 520 that can be lowered into and raised from the wellbore by a support line 518 or a tubular string. The canister system 520 comprises a first compartment containing an isocyanate component and a second compartment containing an organic polyol component. As explained previously, the organic polyol component may be pre-blended with blowing agents, catalysts, and other auxiliary components.

At the time of deployment, the canister system 520 can be actuated to combine the isocyanate component and the organic polyol component of the expandable polymer grout system. The actuation of the canister system can be triggered, for example, by a slickline or e-line extending down into the wellbore, by a mechanical trigger and timer, or by a change in pressure. The mixed components of the expandable polymer grout system form a grout 532 that exits the canister system 520 through an outlet at the bottom of the canister system 520 and flows into a tailpipe 530 attached to the bottom of the canister system 520. In certain embodiments, the canister system can include a pressurized fluid that applies pressure to the grout encouraging it to exit the canister system 520. An advantage of the deployment system 522 illustrated in FIG. 5 is that the expandable polymer grout system components are mixed proximate to the target location 534 and flow to the target location before the grout 532 cures and forms a hardened polymer seal along the sand screen.

The grout 532 flows through the tailpipe 530 toward a target location adjacent to the potential failure point 544. In contrast to the previous example deployment systems, the deployment system 522 of FIG. 5 includes a bladder 579 to assist with the placement of the grout 532. As illustrated in FIG. 5, the bladder 579 can be expanded when the canister system 520 and tailpipe 530 are located adjacent to the target location 534. The bladder 579 pushes the grout 532 exiting the tailpipe 530 to the outer perimeter of the sand screen 540, thereby encouraging the grout 532 to expand through the sand screen 540 and into the annular pack 542. After the grout 532 cures to become a hardened polymer seal along the potential failure point 544 of the sand screen 540, the bladder 579 can be deflated and the deployment system 522 can be retracted from the wellbore. Accordingly, unlike some of the other embodiments described herein, the deployment system 522 is not immediately retracted after deploying the grout 532. Instead, the deployment system 522 remains in place with the bladder 579 expanded to provide time for the grout 532 to cure into the hardened polymer seal 533.

FIG. 6 illustrates the well system 550 of FIG. 5 after the deployment system 522 has been removed from the well system 550. As shown in FIG. 6, the grout has expanded through the sand screen 540 into the annular pack 542 and has cured to form the polymer seal 533. The expanding characteristic of the grout 532 is an advantage in that it surrounds the potential failure point 544 and fills voids in the annular pack 542 adjacent to the failure point 544. The polymer seal 533 covers the potential failure point 544 in the screen, thereby reducing the likelihood that the sand screen 540 will fail at that point. In certain embodiments, the polymer seal 533 may extend radially through a portion of the annular pack 542 toward the formation 578. In other embodiments, the volume of the expandable polymer grout system may be configured so that it expands to form a polymer seal that extends radially from the sand screen 540, through the entirety of the annular pack 542, and to the formation 578.

As described in connection with FIGS. 1-4, the components of the expandable polymer grout system can be selected to form a polymer seal that is either permeable to fluids or impermeable to fluids. In the example illustrated in FIG. 6, the polymer seal 533 is an open cell (permeable) polymer that allows production of fluids (e.g., hydrocarbon fluids) and/or gas (e.g., methane) from the formation 578 to flow through the seal. Accordingly, after the potential failure point 544 has been treated to form the polymer seal 533, fluids can continue to be produced along the interval of the sand screen 540 that has been treated with the polymer seal 533.

Although embodiments described herein are made with reference to the examples illustrated in the figures, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A method for sealing a sand screen in a wellbore, the method comprising:

identifying a failure point in the sand screen, wherein the sand screen is surrounded by an annular pack;

providing, with a deployment system, an expandable polymer grout system to a target location within the wellbore, wherein the expandable polymer grout system comprises an isocyanate component, an organic polyol component, and a blowing agent;

combining, with the deployment system, components of the expandable polymer grout system within the wellbore to form a grout;

delivering the grout to the failure point in the sand screen; and allowing the grout to cure thereby forming a polymer seal at the failure point in the sand screen, wherein the polymer seal extends into and seals at least a portion of the annular pack adjacent to the failure point, and wherein the polymer seal leaves unsealed at least a portion of the sand screen to permit continued fluid flow at the portion of the sand screen that is unsealed.

2. The method of claim 1, wherein the polymer seal is impermeable to production of hydrocarbon fluids and gas.

3. The method of claim 1, wherein the polymer seal includes one or more of sand, gravel, or proppant located in the annular pack along an exterior of the sand screen.

4. The method of claim 1, wherein the polymer seal extends into a formation in which the wellbore is located.

5. The method of claim 1, wherein the deployment system comprises:

a mixer that combines the isocyanate component, the organic polyol component, and the blowing agent of the expandable polymer grout system; and a tailpipe that delivers the grout to the failure point.

6. The method of claim 1, wherein the deployment system comprises an isocyanate canister and an organic polyol canister.

7. A method for sealing a sand screen in a wellbore, the method comprising:

identifying a failure point in the sand screen, wherein the sand screen is surrounded by an annular pack;

combining, with a deployment system at a surface of the wellbore, components of an expandable polymer grout system to form a grout, wherein the components of the expandable polymer grout system comprise an isocyanate component, an organic polyol component, and a blowing agent;

providing the grout to the failure point in the sand screen; and allowing the grout to cure thereby forming a polymer seal at the failure point in the sand screen, wherein the polymer seal extends into and seals at least a portion of the annular pack adjacent to the failure point, and wherein the polymer seal leaves unsealed at least a portion of the sand screen to permit continued fluid flow at the portion of the sand screen that is unsealed.

8. The method of claim 7, wherein the polymer seal is impermeable to production of hydrocarbon fluids and gas.

9. The method of claim 7, wherein the polymer seal includes one or more of sand, gravel, or proppant located in the annular pack along an exterior of the sand screen.

10. The method of claim 7, wherein the polymer seal extends into a formation in which the wellbore is located.

11. The method of claim 7, wherein the deployment system comprises:

a mixer that combines the components of the expandable polymer grout system at the surface of the wellbore;

a conduit that delivers the grout from the mixer into the wellbore; and a tailpipe that delivers the grout to the failure point.

12. The method of claim 7, wherein a volume of the polymer seal within the sand screen is mechanically milled following curing.

13. A method for sealing a sand screen in a wellbore, the method comprising:

identifying a potential failure point in the sand screen, wherein the sand screen is surrounded by an annular pack;

combining, with a deployment system, components of an expandable polymer grout system to form a grout, wherein the components of the expandable polymer grout system comprise an isocyanate component, an organic polyol component, and a blowing agent;

delivering the grout to the potential failure point in the sand screen; and allowing the grout to cure thereby forming a polymer seal at the potential failure point in the sand screen, wherein the polymer seal extends into and seals at least a portion of the annular pack adjacent to the failure point, and wherein the polymer seal leaves unsealed at least a portion of the sand screen to permit continued fluid flow at the portion of the sand screen that is unsealed.

14. The method of claim 13, wherein the potential failure point is adjacent to a void in the annular pack surrounding the sand screen.

15. The method of claim 13, wherein the deployment system combines the components of the expandable polymer grout system at a surface of the wellbore.

16. The method of claim 13, wherein the deployment system combines the components of the expandable polymer grout system within the wellbore.

17. The method of claim 13, wherein the deployment system comprises:

a mixer that combines the components of the expandable polymer grout system; and a tailpipe that delivers the grout to the potential failure point.

18. The method of claim 13, wherein the deployment system comprises an isocyanate canister and an organic polyol canister.

* * * * *